US007107980B1

(12) United States Patent
Craig

(10) Patent No.: US 7,107,980 B1
(45) Date of Patent: Sep. 19, 2006

(54) CARPENTER'S MARKING DEVICE

(76) Inventor: Donald Lee Craig, 5959 Whitewood Ave., Lakewood, CA (US) 90712

( * ) Notice: Subject to any disclaimer, the term of this patent is extended or adjusted under 35 U.S.C. 154(b) by 144 days.

(21) Appl. No.: 10/835,682

(22) Filed: Apr. 30, 2004

Related U.S. Application Data

(60) Provisional application No. 60/466,898, filed on May 1, 2003.

(51) Int. Cl.
*F41B 11/00* (2006.01)

(52) U.S. Cl. ..... 124/64; 33/227; 33/282; 33/286; 33/290

(58) Field of Classification Search ..... 33/227, 33/282, 286, 290, 1 G, DIG. 21; 124/73
See application file for complete search history.

(56) References Cited

U.S. PATENT DOCUMENTS 3,505,739 A * 4/1970 Abrams ..... 33/227
4,448,528 A * 5/1984 McManus ..... 356/250
5,265,582 A * 11/1993 Bhogal ..... 124/73
5,333,594 A * 8/1994 Robinson ..... 124/73
5,537,205 A * 7/1996 Costa et al. ..... 356/250
5,644,850 A * 7/1997 Costales ..... 33/282
5,754,287 A * 5/1998 Clarke ..... 356/250
6,035,843 A * 3/2000 Smith et al. ..... 124/77
6,168,348 B1 * 1/2001 Meyer et al. ..... 404/90
6,318,350 B1 * 11/2001 Williams ..... 124/71
6,508,384 B1 * 1/2003 Tien et al. ..... 221/289
6,725,551 B1 * 4/2004 Sutton ..... 33/286

* cited by examiner

*Primary Examiner*—Michelle Clement
*Assistant Examiner*—Stewart Knox
(74) *Attorney, Agent, or Firm*—Kenneth L Tolar

(57) ABSTRACT

A device for assisting a user in marking an overhead surface to correspond with a mark on a surface below includes a substantially hollow housing having pressurized gas containers received therein. The pressurized gas containers are in communication with a projection barrel extending upwardly from the housing. A lower laser module is positioned on the lower surface of the housing for projecting a laser beam downwardly onto a target mark on an underlying surface. The paint ball projection barrel is coaxial with the lower laser module such that when the laser beam is directed toward the target mark, a paint ball can be projected upwardly to produce an overhead mark that is axially aligned with the target mark.

15 Claims, 3 Drawing Sheets

CARPENTER'S MARKING DEVICE

CROSS REFERENCE TO RELATED APPLICATIONS

This application is entitled to the benefit of provisional application No. 60/466,898 filed on May 1, 2003.

BACKGROUND OF THE INVENTION

1. Technical Field of the Invention

The present invention relates to a device that assists a construction worker in marking an overhead surface so that the resulting mark is axially aligned with an existing mark on a surface below.

2. Description of the Prior Art

Various construction workers such as carpenters, electricians, pipe fitters, framers, etc., typically mark locations where certain fixtures or structures are to be installed by snapping chalk lines on the floor, wall, etc. Often, it is necessary to transfer the location of a specific mark on the floor to a corresponding location on the ceiling above to accurately position and secure a wall or similar structure. Typically, this is accomplished by using a ladder which is tedious, time consuming and often results in inaccuracies. Accordingly, there is currently a need for a device that assists a construction worker in transferring a floor mark to a corresponding location on an overhead surface. The present invention satisfies this need by providing a device having a paint ball projector that is aligned with an existing mark on a subsurface for projecting a paint ball upwardly to mark a corresponding spot on the ceiling above. Not only is the device accurate, but it allows a user to mark an overhead surface without the assistance of a co-worker.

SUMMARY OF THE INVENTION

The present invention relates to a device for assisting a workman in marking an overhead surface that is axially aligned with an existing mark on a floor. The device comprises a substantially hollow housing having an upper surface, a lower surface and an interior chamber. A handle is secured to the upper surface of the housing for assisting a user in maneuvering the device. Mounted on the lower surface are a plurality of locking casters allowing the device to be easily transported from one location to another. Also on the lower surface of the housing is a lower laser module that projects a laser beam downwardly. Positioned on the upper surface of the housing and coaxially aligned with the lower laser module is a paint ball barrel. Connected to the lower end of the barrel is a gas tube in communication with a gas source such as carbon dioxide or pressurized air. A gas pressure adjustment means selectively varies the pressure of the gas delivered to the paint ball barrel. A switch means briefly delivers a stream of pressurized gas to the barrel to project a paint ball upwardly. A sensitive level is positioned on the upper surface of the housing that can be used in conjunction with a leveling adjuster and adjustment arm on each of the castors to assure that the paint ball barrel is perpendicular to a horizontal plane.

An upper laser module is positioned on the upper surface of the housing, adjacent the paint ball barrel, for projecting a laser beam upwardly towards an overhead surface. The upper laser module is used in the event that a paint ball cannot be practically projected toward the overhead surface.

It is therefore an object of the present invention to provide a device that allows a user to easily and conveniently mark an overhead surface.

It is another object of the present invention to provide a device that allows a user to easily align an overhead mark with that positioned on a surface below.

Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
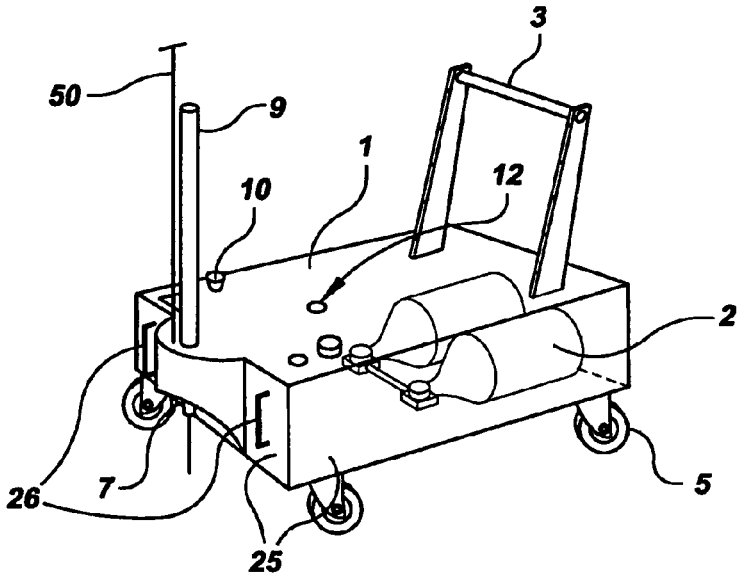
FIG. 1 is a perspective view of the device.
Figure 2:
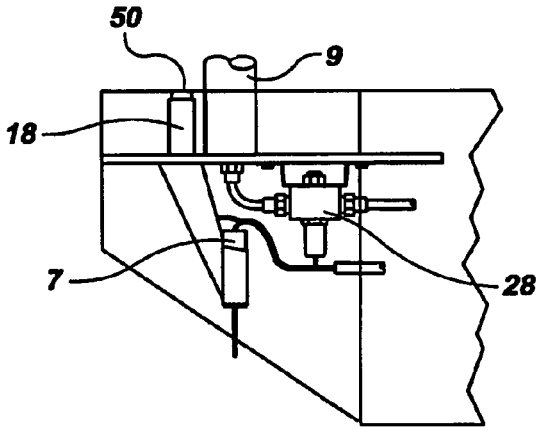
FIG. 2 is a detailed view of the laser modules and paint ball projecting means.
Figure 3:
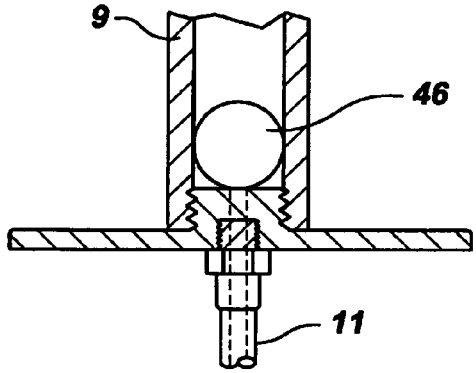
FIG. 3 is a cross-sectional view of the paint ball barrel with a paint ball received therein.
Figure 4:
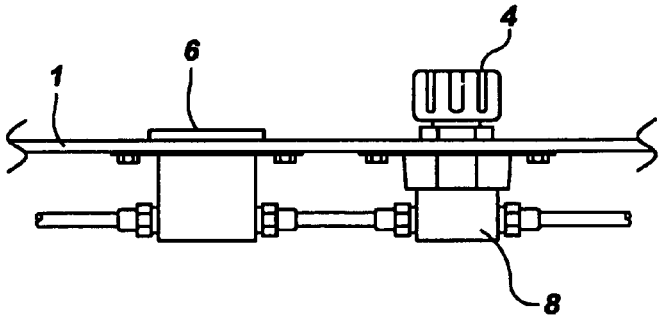
FIG. 4 is a detailed view of the projection gas regulator.
Figure 5:
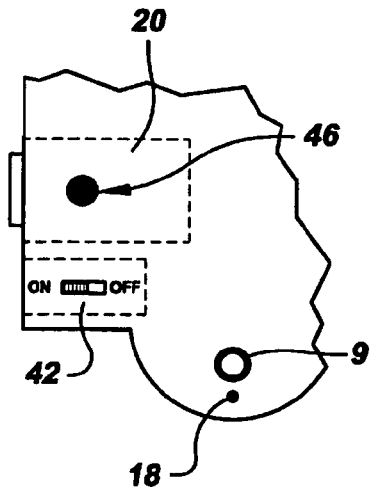
FIG. 5 is a cutaway top view of the device.
Figure 6:
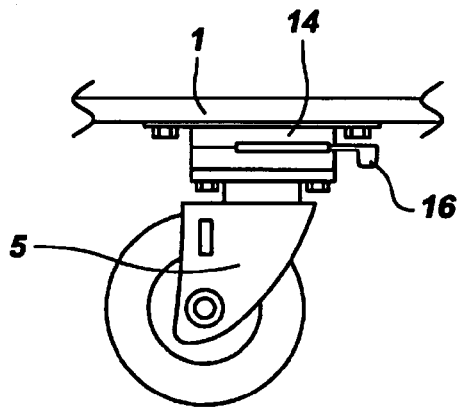
FIG. 6 is a side, detailed view of the leveling caster.
Figure 7:
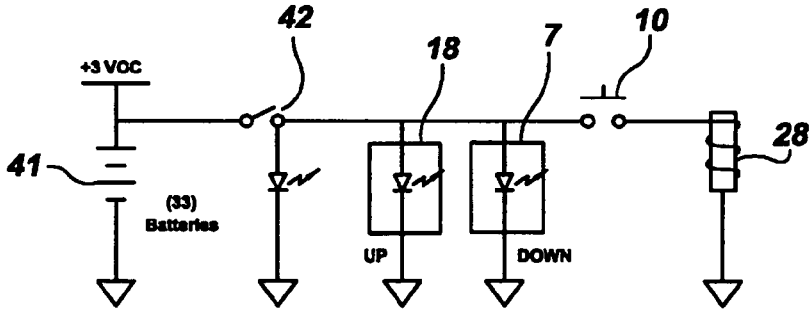
FIG. 7 is a circuit diagram of the various electrical components.

The present invention relates to a device for assisting a worker in marking an overhead surface so that the resulting mark is axially aligned with an existing mark on a floor. The device comprises a substantially hollow housing 1 having an upper surface, a lower surface, one or more sidewalls 25 and an interior chamber. Mounted on the lower surface are a plurality of locking casters 5 allowing the device to be easily transported along a supporting surface and anchored thereto. As such, a handle 3 is disposed on the upper surface which can be grasped when maneuvering the housing along the supporting surface. Handles 26 may be positioned on one of the sidewalls for further positioning an alignment means described, infra. The housing also includes a drawer 20 for storing a plurality of paint balls 46 or similar surface coated projectiles.

The alignment means includes a lower laser module 7 on the lower surface of the housing that projects a laser beam downwardly. Vertically extending from the upper surface of the housing and coaxial with the lower laser module is a paint ball barrel 9.

At the lower end of the barrel is a paint ball projection means including a gas tube 11 having a solenoid valve 28 connected thereto. The tube is in communication with a pressurized gas source such as carbon dioxide or pressurized air. The gas source is preferably contained within refillable gas cylinders 2 removably mounted in the housing interior chamber, though any other conventional storage means can be used.

A gas pressure adjustment means includes a pressure adjustment dial 4 and pressure gauge 6 that are positioned on the upper surface of the housing, which are in communication with a gas regulator 8 for selectively varying the pressure of gas delivered to the paint ball barrel. The solenoid valve is activated with a firing switch 10 that causes the solenoid to quickly open and close to deliver a stream of pressurized gas to the paint ball barrel thereby projecting the paint ball upwardly. A level adjustment means includes a sensitive level 12 positioned on the upper surface of the housing that can be used in conjunction with a leveling adjuster 14 and adjustment arm 16 on each of the castors to assure that the paint ball barrel is perpendicular to a horizontal plane.

An upper laser module 18 is positioned on the upper surface of the housing adjacent the paint ball barrel for projecting a laser beam upwardly towards an overhead surface. The upper laser module may be used in the event that the paint ball launcher cannot be properly used.

The laser modules and solenoid valve are preferably powered with batteries 41. Additionally, an activation switch 42 is positioned on the housing for delivering power to the electronic components. The laser modules are capable of projecting a beam having a divergence of less than 2 milliradians to significantly enhance the positioning precision of the alignment and marking means.

To use the above described device, a worker snaps a chalk line or otherwise marks an underlying surface. To mark an overhead surface to correspond with that on the underlying surface, the worker positions the housing such that the beam projected by the lower laser module strikes the mark created on the underlying surface. Simultaneously, the paint barrel will be precisely aimed at a position on the overhead surface corresponding to the marked surface below. Actuation of the firing switch results in pressurized gas being delivered to the paint ball barrel thereby projecting a paint ball against the overhead surface to form a mark that is axially aligned with the mark below. In the event that the overhead configuration is such that a paint ball cannot be projected thereto, the upper laser module is employed to project a beam 50 to a corresponding location overhead and the location is manually marked.

The above described device is not limited to the exact details of construction and enumeration of parts provided herein. Furthermore, the size, shape and materials of construction can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A carpenter's marking device comprising:

a housing having an upper surface, a lower surface and an interior chamber;

an alignment means positioned on the lower surface of said housing for aligning with an existing target mark on a surface below wherein said alignment means comprises a lower laser module for downwardly projecting a laser beam onto said existing mark;

a marking means positioned on the upper surface of the housing, said marking means coaxially aligned with said alignment means for marking an overhead surface at an axially aligned position relative to the existing target mark wherein said marking means comprises a projectile barrel vertically extending from the upper surface of said housing, said barrel having a surface coated projectile received therein;

a projection means in communication with said barrel for propelling said projectile out of said barrel toward an overhead surface.

2. The marking device according to claim 1 wherein said projection means comprises a pressurized gas source in selective communication with said barrel.

3. The device according to claim 2 further comprising a gas pressure adjustment means for varying the pressure of gas delivered to said barrel to vary the height to which said projectile is propelled.

4. The device according to claim 1 further comprising an upper laser module positioned on the upper surface of said housing, said upper laser module substantially aligned with said lower laser module, said upper laser module projecting a laser beam upwardly toward an overhead surface to illuminate a spot thereon that is axially aligned with the existing target mark on the underlying surface.

5. The device according to claim 1 wherein said housing further includes an extendable and retractable drawer for storing a plurality of projectiles.

6. The device according to claim 1 wherein said housing further includes a plurality of lockable casters fastened to the lower surface thereof for selectively rolling the housing along an underlying surface.

7. The device according to claim 6 further comprising a level adjustment means for adjusting the angular orientation of the marking means relative to the underlying surface.

8. The device according to claim 7 wherein said level adjustment means comprises a sensitive level positioned on the upper surface of said housing, a leveling adjuster and an adjustment arm on each of said castors.

9. A carpenter's marking device comprising:

a housing having an upper surface, a lower surface and an interior chamber; said housing further includes a plurality of lockable casters fastened to the lower surface thereof for selectively rolling the housing along an underlying surface;

an alignment means positioned on the lower surface of said housing for aligning with an existing target mark on an underlying surface;

a marking means positioned on the upper surface of the housing, said marking means coaxially aligned with said alignment means for marking an overhead surface at an axially aligned position relative to the existing target mark.

10. The marking device according to claim 9 wherein said alignment means comprises a lower laser module for downwardly projecting a laser beam onto said existing mark.

11. The marking device according to claim 9 wherein said projection means comprises a pressurized gas source in selective communication with said barrel.

12. The device according to claim 11 further comprising a gas pressure adjustment means for varying the pressure of gas delivered to said barrel to vary the height to which said projectile is propelled.

13. The device according to claim 9 further comprising an upper laser module positioned on the upper surface of said housing, said upper laser module substantially aligned with said lower laser module, said upper laser module projecting a laser beam upwardly toward an overhead surface to illuminate a spot thereon that is axially aligned with the existing target mark on the underlying surface.

14. The device according to claim 9 wherein said housing further includes an extendable and retractable drawer for storing a plurality of projectiles.

15. The device according to claim 9 further comprising a level adjustment means for adjusting the angular orientation of the marking means relative to the underlying surface.

* * * * *